US005857909A

United States Patent [19]

Rubin

[11] Patent Number: 5,857,909

[45] Date of Patent: Jan. 12, 1999

[54] COMPUTERIZED ROULETTE GAME TABLE

[76] Inventor: Bruce Rubin, Rte. 2, Box 120 T, Deming, N. Mex. 88030

[21] Appl. No.: 668,917

[22] Filed: Jun. 24, 1996

[51] Int. Cl.[6] ..... A63F 5/00

[52] U.S. Cl. ..... 463/17

[58] Field of Search ..... 273/142 R, 142 B, 273/142 E, 142 F, 142 G; 463/17, 22, 23, 25, 26, 27

[56] References Cited

U.S. PATENT DOCUMENTS

| | | | |
|---|---|---|---|
| 4,396,193 | 8/1983 | Reinhardt et al. | 273/142 B |
| 4,906,005 | 3/1990 | Manabe | 273/142 B |
| 5,588,650 | 12/1996 | Eman et al. | 273/142 B |

*Primary Examiner*—George Manuel
*Attorney, Agent, or Firm*—Paul Adams; Jeffrey D. Myers

[57] ABSTRACT

An electronically and physically improved roulette game table designed to provoke and stimulate the interest of novice, occasional, and veteran roulette game player is disclosed. The roulette game table comprises: a playing table; a rotably mounted wheel having a plurality of ball receiving sector compartments; event registration means for registering the sector compartment in which a ball might come to rest; and, a computer programmed to display historical and recent events. A preferred aspect of this invention provides for a roulette game table as above wherein the computer is additionally programmed to summarize the most recent events, and wherein the computer is programmed to display the last ten events. The roulette game table is additionally marked to allow game players to wager on events sequentially occurring in two and more moves and the computer is programmed to display payoffs for those sequentially occurring events. The most preferred embodiment additionally provides for multiple individual bet placement layouts around its periphery. The electronically improved roulette game table provides for the possibility of hereto before unavailable bet combinations; sequential bet possibilities which will attract game players with astronomical, ever changing and electronically posted payoffs which will be exceptionally lucrative to the casinos.

12 Claims, 3 Drawing Sheets

COMPUTERIZED ROULETTE GAME TABLE

FIELD OF THE INVENTION

This invention relates to roulette game tables and more particularly to such roulette game tables which utilize electronics and electrical displays and devices as well as individual betting layouts.

BACKGROUND OF THE INVENTION

The gaming industry, sanctioned by increasing numbers of states, has experienced dynamic growth. Casinos, spurred by growing competition, are investing heavily in theme buildings and more elaborate equipment to compete for game players.

U.S. Pat. No. 4,396,193 issued to R. L. Reinhardt et al. disclosed means to automatically sense which compartment the ball was received in and automatically illuminate a corresponding table display, as well as processor means for computing a multi-bit data word used to display winning combinations. While this innovation enhanced the color and attractiveness of the roulette game table it displayed information known to all but the most novice game players. What is appreciated by the more experienced game player is more information upon which to base their betting decisions and hunches. Such information, comparable to a race horse's track history, makes the game more interesting to intelligent better informed patrons. From the casino's viewpoint, such historical event information allows for the possibility of heretobefore unavailable bet combinations; bet combinations which will challenge and entice game players with enormous long shot and pool payoffs which will be exceptionally profitable to the casino.

OBJECTS AND STATEMENT OF THE INVENTION

It is an object of this invention to disclose innovations to the roulette game table which will stimulate the interest of veteran game players. It is an object of this invention to sumarize historical event information. It is an object of this invention to disclose a new dimension to a roulette game table by presenting the possibility of new bet combinations for the game player to consider. It is a further object of this invention to disclose an innovation to the roulette game table which promotes interest among game players, offers exciting payoffs, and concurrently is exceptionally lucrative for casinos. It is an object of this invention to allow game players to wager on events sequentially occurring in two and more moves. It is yet a further object of this invention to disclose a format for a roulette game table which provides individual bet placement areas for each game player to facilitate identification of their bets.

One aspect of this invention provides for a roulette game table comprising: a playing table; a rotably mounted wheel having a plurality of ball receiving sector compartments; event registration means for registering the sector compartment in which a ball might come to rest; and, a computer programmed to display the most recent events.

A preferred aspect of this invention provides for a roulette game table as above wherein the computer is additionally programmed to summarize the most recent events, and wherein the computer is programmed to display the last ten events. The roulette game table is additionally marked to allow game players to wager on events sequentially occurring in two and more moves and the computer is programmed to display payoffs for those sequentially occurring events. The most preferred embodiment additionally provides for multiple individual bet placement layouts around its periphery.

Various other objects, advantages and features of novelty which characterize this invention, are pointed out with particularity in the claims annexed to, and form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description make reference to the annexed drawings wherein.

Figure 1:
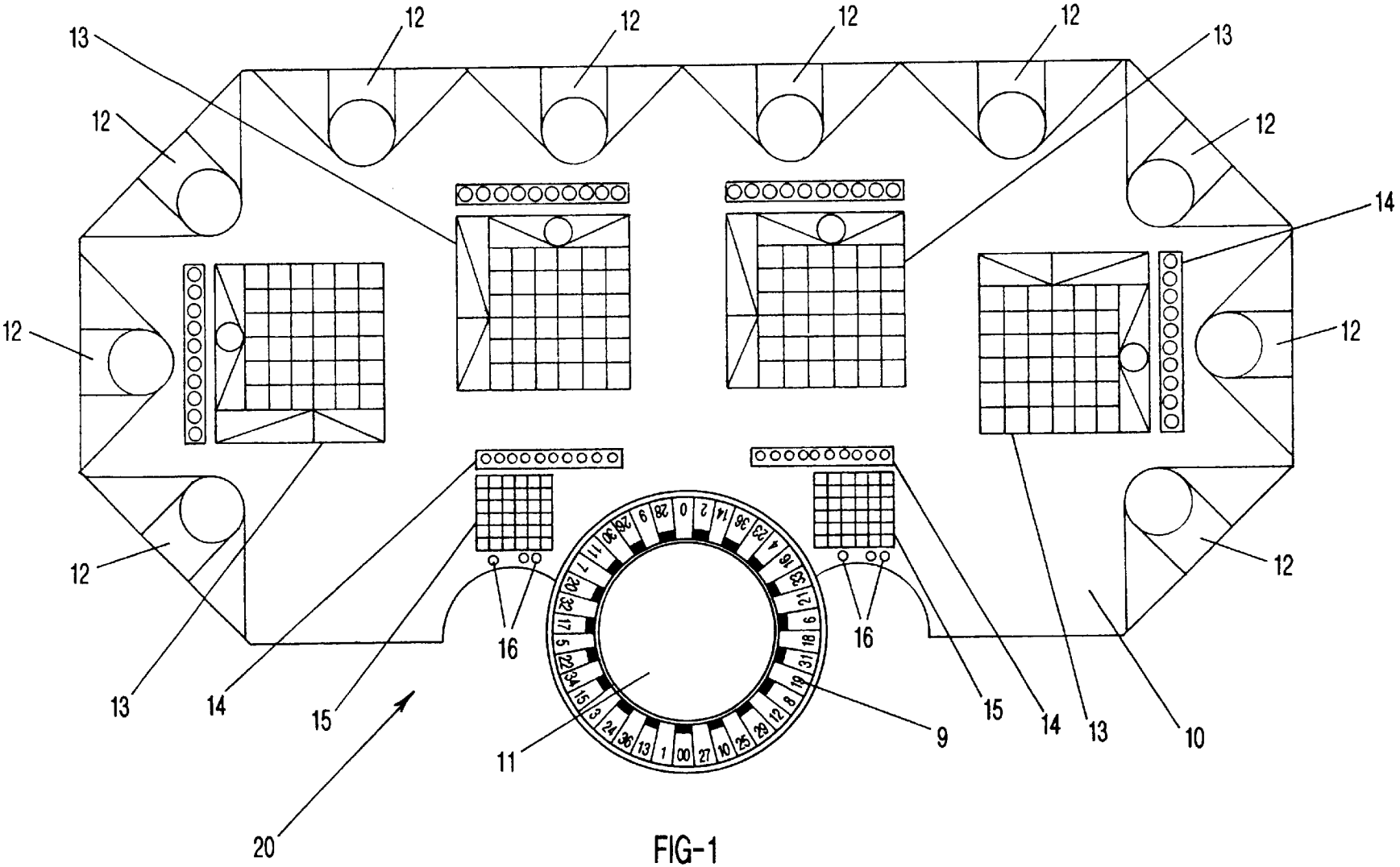
FIG. 1 is a plan view of a Roulette Game Table, the subject of this invention.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a plan view of a Roulette Game Table 20, the subject of this invention. The Roulette Game Table 20 comprises a playing table 10; a rotably mounted wheel 11 having a plurality of ball receiving sector compartments 9; event registration means 15 for registering the sector compartment in which a ball (not shown) might come to rest; and a computer (not shown) which is programmed to display the most recent events. In FIG. 1 a keypad 15, 16 comprises 38 keys to allow the croupier to manually enter events (an event being defined as occuring when the ball (not shown) is slotted in a receiving sector compartment 9 of the rotably mounted wheel 11) into the computer as they occur. Alternatively, event registration means 15,16 could be performed automatically by photoelectic, magnetic sensory or other scanning means to sense when the ball (not shown) is slotted in a receiving sector compartment 9 of the rotably mounted wheel 11. Most preferably, the computer (not shown) is programmed to display the last ten events in event summary areas 14 on the playing table 10. Most preferably the playing table 10 comprises multiple individual bet placement layouts 12 for game players and onlookers around its periphery and has multiple event displays 13, each event display 13 being positioned to serve a sub-group of game players and/or onlookers.

Figure 2:
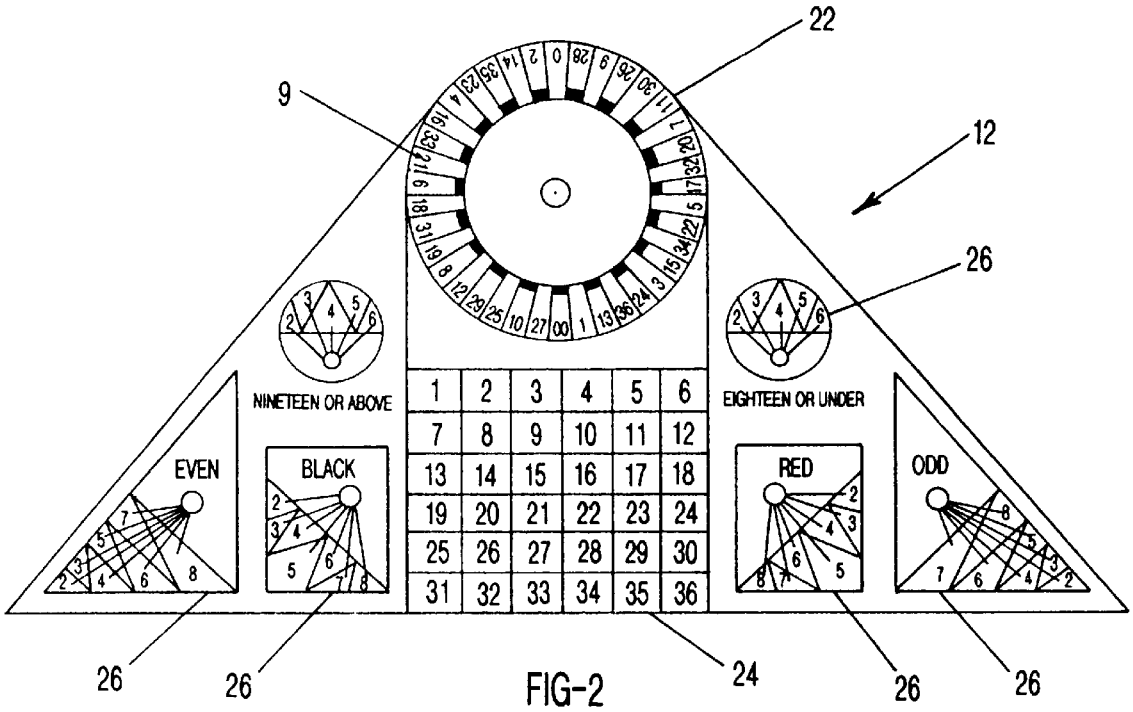
FIG. 2 is an enlarged plan view of an individual bet placement layout taken from a peripheral position of the Roulette Game Table shown in FIG. 1.

FIG. 2 is an enlarged plan view of an individual bet placement layout 12 taken from a peripheral position of the Roulette Game Table 20 shown in FIG. 1. The individual bet placement layout 12 may comprise a most recent event illuminated wheel display 22, a square bet placement area 24, having thirty-six sub-squares, as well as new bet combination area placements 26 for bets on, for example, odd, even, black, red, eighteen or under, nineteen or above. A digital payout display (not shown) to show payout ratios for sequential bets placed could be included on each individual bet placement layout 12. A pressure sensitive material on the new bet combination area placements 26 could allow the game player to select to bet on the outcome of multiple sequential events. A digital payout display 22 which would display odds for new bet combinations could be incorporated into the individual bet placement layout 12. The new bet combination display could alternatively flash odds for multiple events or alternatively display odds only when the pressure sensitive material were touched. Most preferably the computer (not shown) is programmed to display payoffs for events sequentially occurring in two and more moves which are determined in combination with a pool of roulette game tables 20.

Figure 3:
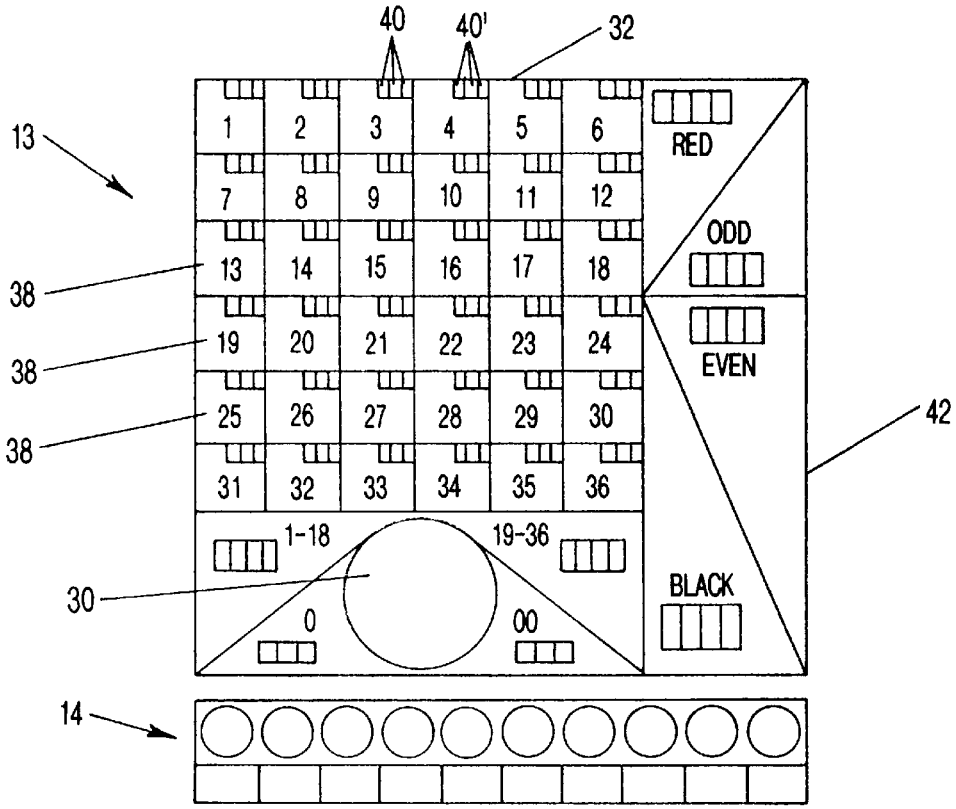
FIG. 3 is an enlarged plan view of an event and summary layout shown on a central portion of the Roulette Game Table as shown in FIG. 1.

FIG. 3 is an enlarged plan view of an event and summary layout 13 shown on a central portion of the Roulette Game Table 20 as shown in FIG. 1. Most preferably there are multiple event and summary layouts 13, each positioned to serve a sub-group of adjacent game players and onlookers. The event and summary layout 13 includes an event counter or clock 30. The clock 30 could record an arbitrary beginning time after which events were summarized. The event and summary layout 13 would additionally include a square summary area 32, having thirty-six numbered sub-squares 38, each sub-square 38 having a digital display 40 to record the number of occurrences of its number over the arbitrary time period shown on the clock 30 or in the events counted by the event counter. In addition to the thirty-six numbered sub-squares 38 designated sequence bet areas 42 could show new bet combination occurences, for example, odd, even, black, red, eighteen or under, or nineteen or above, in the clock 30 time period or in the period in which the events were being counted. Beneath each event and summary layout 13, an historical display 14 of the last ten events is included. This historical display 14 could be computer controlled and arranged to always display the 10'th last event on the right, the most recent event on the left, and the eight intervening events in order therebetween. The historical display 14 allows or facilitates wagering on events sequentially occurring in two and more moves.

The function of the clock 30 is to flag a wager on events sequentially occurring in two and more moves. When a sequence bet were placed then the clock 30 would be tripped so that the croupier could identify events which occured after that time by use of the historical display 14 in conjunction with a digital time display 16 positioned therebelow on the lower central portion of the roulette game table 20. Alternatively, the events could be flagged by the computer (not shown). When the pressure sensitive material sensed sustained pressure a red flag lamp 44 at the appropriate designated sequence bet area 42 could be switched on. This red flag lamp 44 could be programmed to remain on until such time as a losing bet occured in the sequence of future events. At that time it could be programmed to flash until such time as the croupier removed the stake which caused sustained pressure on the pressure sensitive material. If a winning event occured then bells and whistles could be programmed to ring. The computer (not shown) is being inputted with both the sequence of events and the sequence wager through the pressure sensitive material. After this information has been inputted it is not a difficult matter for the computer (not shown) to control the red flag lamp 44 and determine the outcome of the wager.

Figure 4:
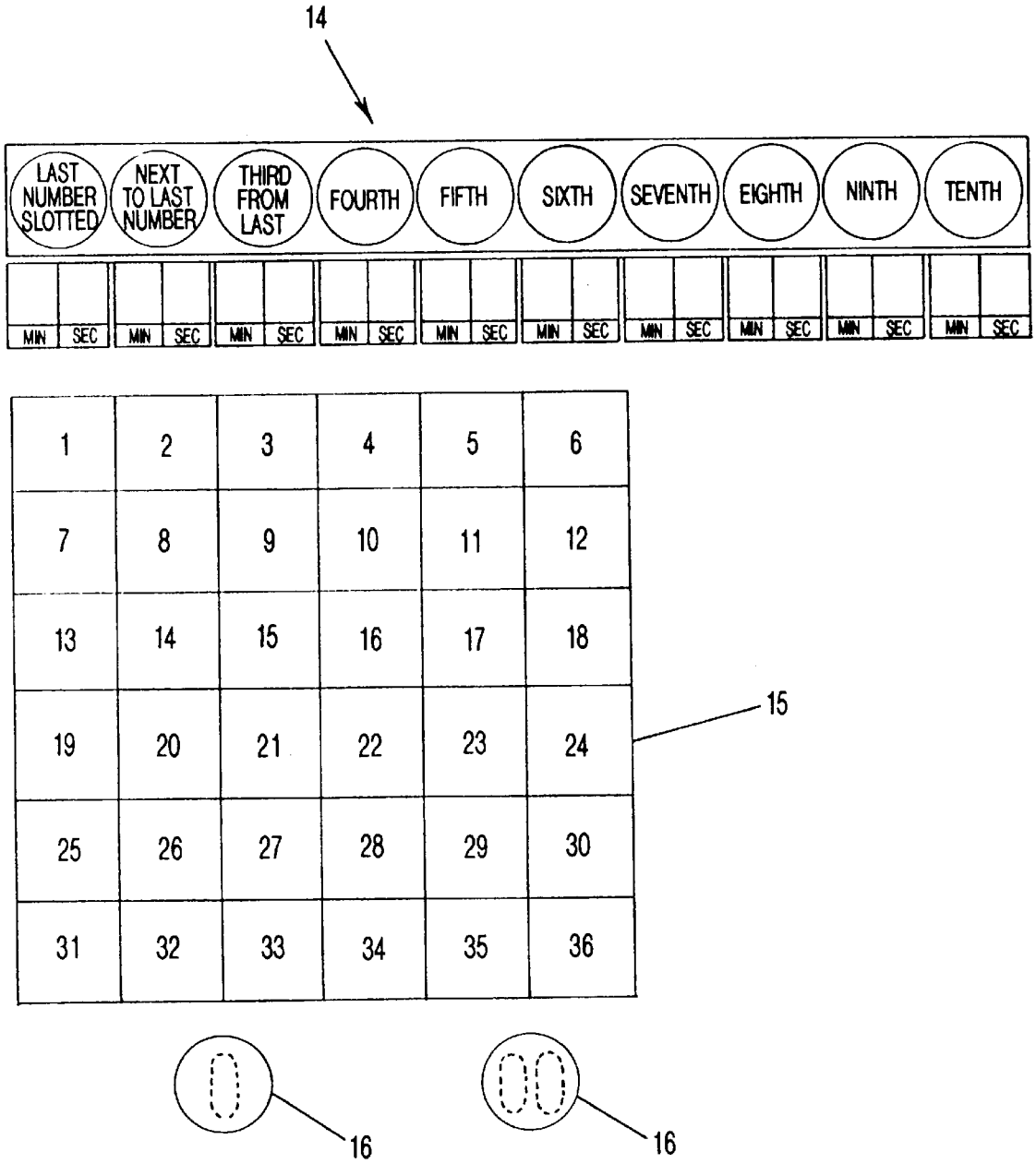
FIG. 4 is an enlarged plan view of the croupier's portion of the Roulette Game Table as shown in the lower central portion of FIG. 1.

FIG. 4 is an enlarged plan view of the croupier's portion of the Roulette Game Table 20 shown in the lower central portion of FIG. 1. The croupier's portion of the Roulette Game Table 20 comprises a square keypad area 15 having thirty-six keys, and two additional keys 16, to allow the croupier to enter events into the computer as they occur. The croupier's portion of the Roulette Game Table 20 also comprises an historical display 14 of the last ten events. This historical display 14 is arranged to always display the 10'th last event on the right, the most recent event on the left, and the eight intervening events in order therebetween. Upon each suceeding event the number previously displayed in the 10'th position would disappear and all remaining numbers would be shifted rightwardly so that the number of the most recent event could appear in the extreme left position. The historical display 14 facilitates paying off wagers on events sequentially occurring in two and more moves.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A roulette game table comprising:

a playing table;

a rotatably mounted wheel having a plurality of ball receiving sector compartments;

event registration means for registering the sector compartments in which a ball might come to rest; and, a computer to record bets based on multiple sequential events and the occurrence of multiple sequential events; including at least one monitor for displaying said bets and the occurrences of said events.

2. A roulette game table as in claim 1 wherein the computer is additionally programmed to compare each bet based on multiple sequential events with the occurrence of multiple sequential events and display a winning bet.

3. A roulette game table as in claim 2 wherein the computer is programmed to record and display the last ten events.

4. A roulette game table as in claim 3 wherein the computer is programmed to record and display payoff for events sequentially occurring in two and more moves which are determined in combination with a pool of roulette game tables.

5. A roulette game table as in claim 4 wherein the roulette game table further comprises multiple individual best placement layouts around its periphery.

6. A roulette game table as in claim 5 wherein there are multiple event displays on the table, each event display positioned to serve a sub-group of game players.

7. A roulette game table comprising:

a playing table having a plurality of player stations;

a rotatable mounted wheel having a Plurality of ball receiving sector compartments;

means for identifying the sector compartment in which a ball might come to rest; and wherein each of said player stations further comprises multiple bet placement layouts for each game player.

8. A roulette game table as in claim 7 wherein there are multiple event displays on the table, each event display positioned to serve a sub-group of game players.

9. A roulette game table as in claim 8 additionally comprising a computer programmed to records bets based on multiple sequential events and the occurrence of multiple sequential events; and at least one monitor for displaying said bets and the occurrences of said events.

10. A roulette game table as in claim 9 wherein said computer is programmed to display the last ten events on at least one monitor.

11. A roulette game table as in claim 10 wherein the computer is programmed to display on said player station monitors payoff for events sequentially occurring in two and more moves which are determined in combination with a pool of roulette game tables.

12. A roulette game table comprising:

a playing table including at least one player station, at least one event and summary layout, and a croupier's information input means;

a rotatably mounted wheel having a plurality of ball receiving sectors;

event identifying means for identifying the sector in which a ball comes to rest;

a computer programmed to record identified events; and means for displaying the occurrence of an identified event.

* * * * *